United States Patent [19]

Albertson

[11] Patent Number: 4,502,806

[45] Date of Patent: Mar. 5, 1985

[54] GUTTER CLEANING DEVICE

[76] Inventor: Edward Albertson, 1070 W. Ocean View Ave., Norfolk, Va. 23503

[21] Appl. No.: 492,230

[22] Filed: May 6, 1983

[51] Int. Cl.[3] ..... A47L 13/03; E04D 13/06

[52] U.S. Cl. ..... 401/137; 15/236 R; 239/532; 294/19.1; 401/139; 401/195; 401/261

[58] Field of Search ..... 401/137, 139, 261, 265, 401/195; 239/532; 15/105, 236 R; 294/19

[56] References Cited

U.S. PATENT DOCUMENTS

| | | | |
|---|---|---|---|
| 2,603,892 | 7/1952 | Fischer | 294/19 X |
| 2,817,867 | 12/1957 | Bugbird | 15/236 R |
| 3,023,971 | 3/1962 | Milhous | 401/137 |
| 3,041,655 | 7/1962 | Entler | 401/137 X |
| 3,601,835 | 8/1971 | Morgan . | |
| 3,626,542 | 12/1971 | Despain et al. . | |
| 3,626,542 | 12/1971 | Despain et al. | 294/19.1 X |
| 3,858,267 | 1/1975 | Swannie | 15/236 R |
| 3,972,552 | 8/1976 | Earp, Jr. . | |
| 4,114,938 | 9/1978 | Strader | 294/19.1 |
| 4,303,348 | 12/1981 | O'Brien | 401/137 |

FOREIGN PATENT DOCUMENTS

| | | | |
|---|---|---|---|
| 1045763 | 1/1979 | Canada | 294/19.1 |

*Primary Examiner*—Steven A. Bratlie

*Attorney, Agent, or Firm*—Parkhurst & Oliff

[57] ABSTRACT

A gutter cleaning device having an operative head portion comprising a pair of gutter cleaning plates each of which has a width which is substantially more narrow than the bottom portion of a typical modern gutter, and is shaped with an angled lip extending away from the central plane of the device. A long handle is attached to the cleaning plates through an elbow-shaped connecting member. Roof rake and hose clamp members are interchangeably useful in place of the cleaning plates.

10 Claims, 6 Drawing Figures

FIG 3A
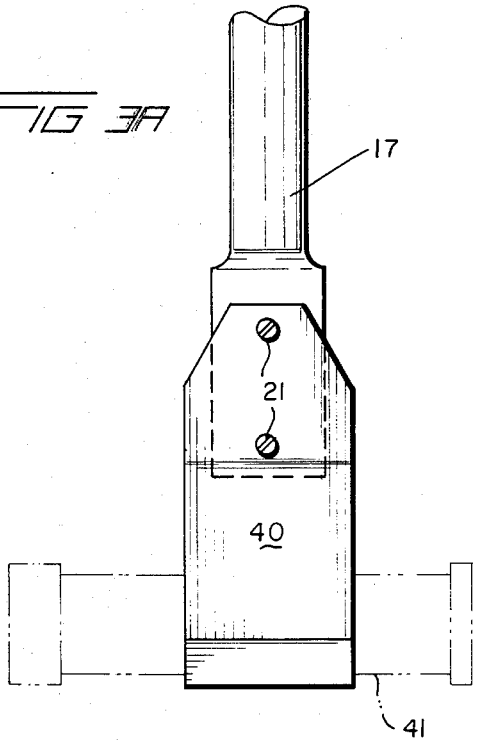
FIG 3B
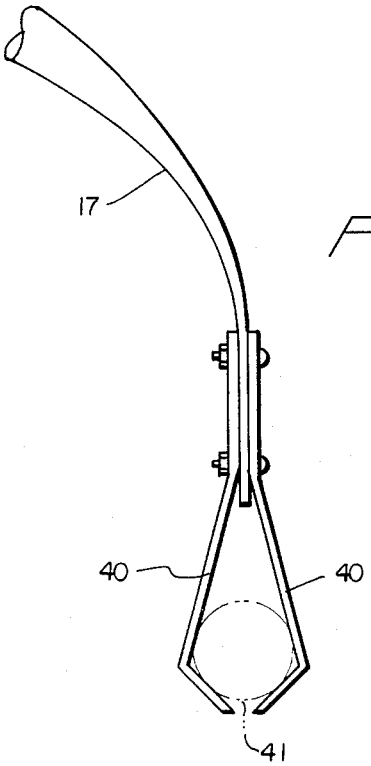
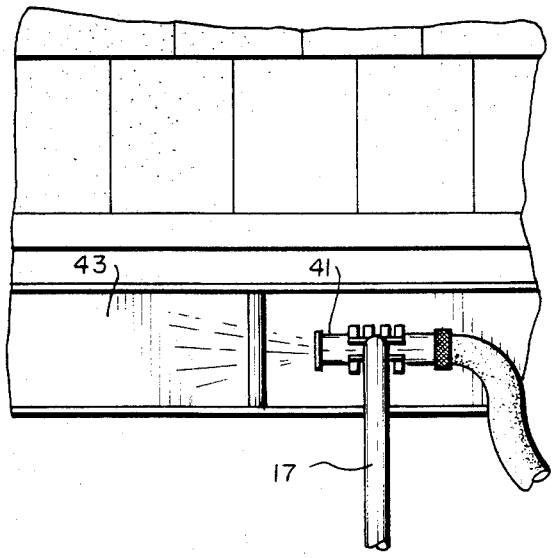
FIG 3C
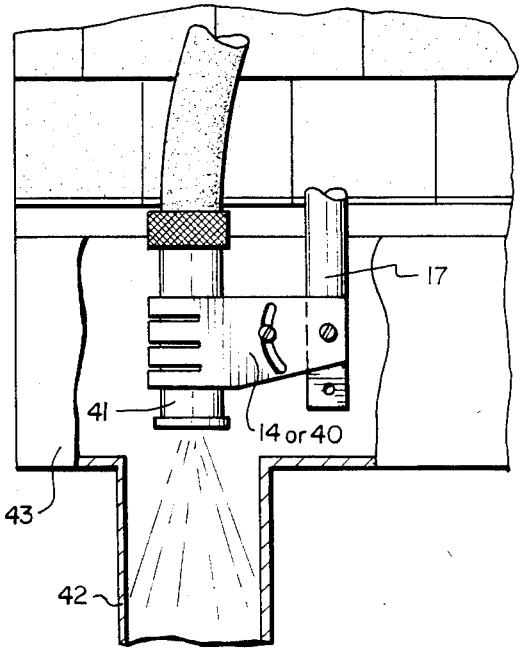
FIG 3D

FIG 4A
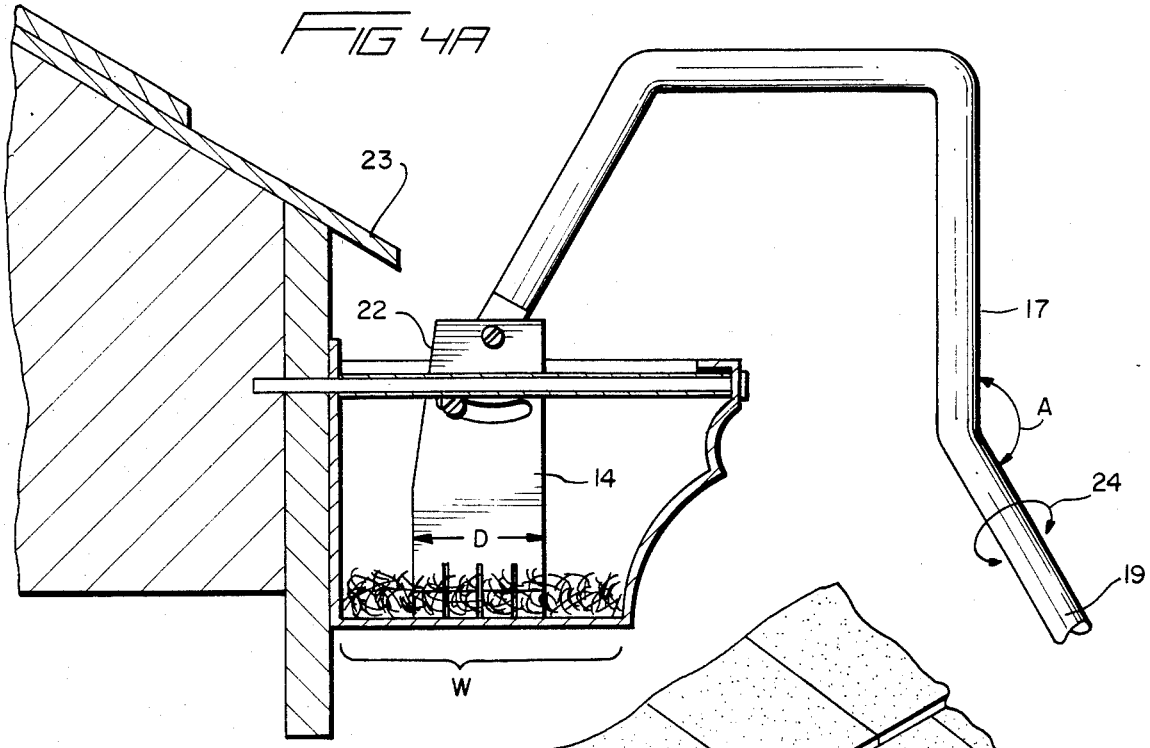
FIG 4B
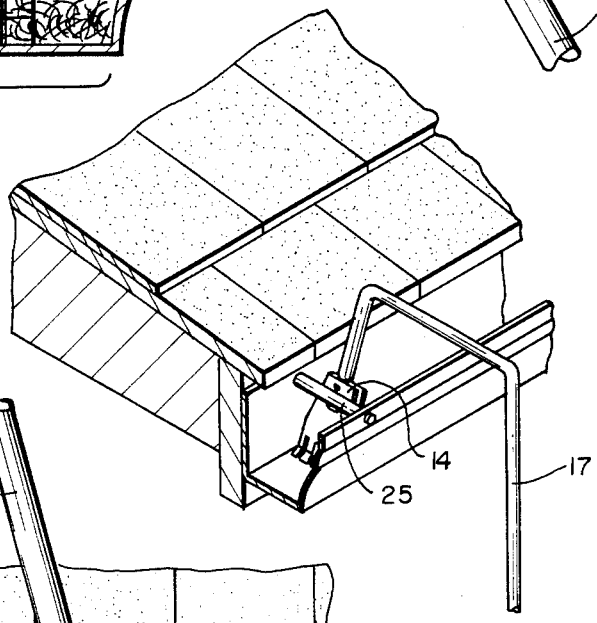
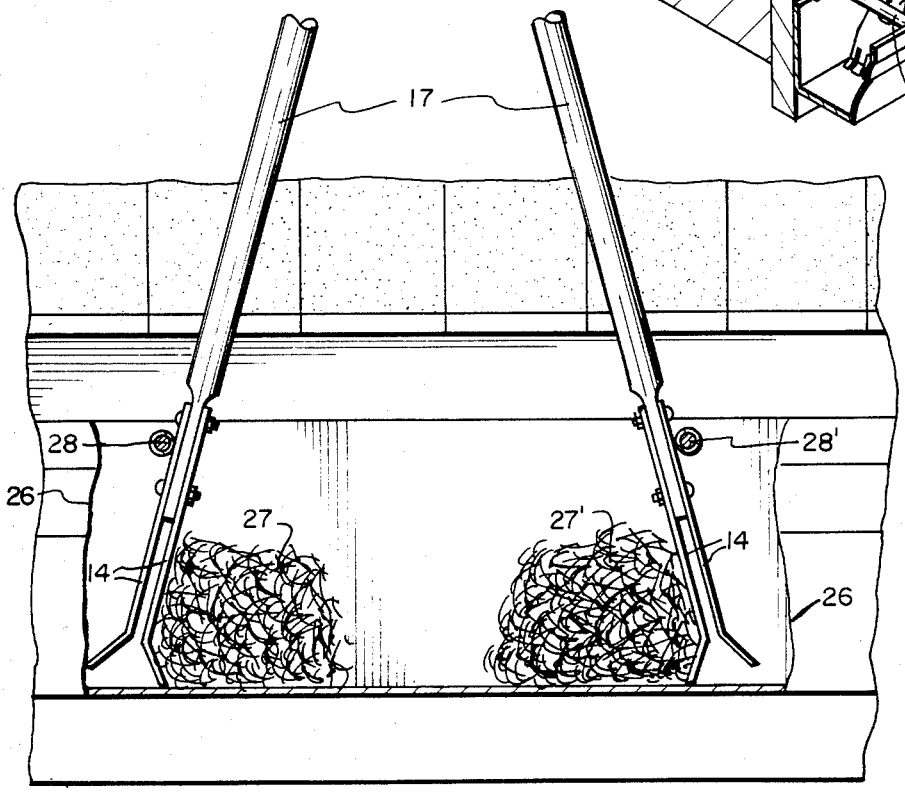
FIG 5

GUTTER CLEANING DEVICE

BACKGROUND

This invention relates to devices for thoroughly cleaning various undesirable matter, such as leaves, pine needles, dirt, roof granules, sand, and other debris from gutters attached to both single and two-story dwellings or buildings where the gutters are elevated substantially above the normal reach of a person standing on the ground below such gutters. More particularly, the present invention is a device for quickly, efficiently, and thoroughly removing such debris from gutters, and various of the embodiments of the device may be adjustable or may be used in conjunction with a rake attachment or garden hose for physically removing washing residual debris from above or within gutters.

The general idea of attempting to provide a tool for cleaning gutters has previously been attempted, as indicated, for example, by Morgan U.S. Pat. No. 3,601,835, Earp U.S. Pat. No. 3,972,552 or Despaine U.S. Pat. No. 3,626,542. However none of those prior gutter cleaning devices provide the structure and efficient cleaning action of the device of the present invention. The Morgan and Earp gutter cleaners both comprise relatively complex devices in the nature of elongated tongs for grasping and lifting bunches of gutter debris from elevated gutters. The Despaine gutter cleaning tool consists of a fork-like device having elongate tangs which extend for substantial lengths from the handle of the device downwardly and laterally in one direction from the handle to fit in a gutter and extend well under the spikes by which the gutter is attached to the dwelling.

However such prior devices suffer a variety of defects which make them inefficient and impractical for thoroughly cleaning gutters. For example, many such prior devices are too wide to extend fully down into the bottom of the cross section of some gutters. Other gutter cleaning devices are too long to work effectively between closely spaced spikes by which gutters may be attached to dwellings, for example, particularly those near corners. Similarly, some gutter cleaning devices are inefficient in cleaning gutter corners. Other devices suffer an angulation problem in that the angle which the long handle makes with the actual cleaning device makes it extremely difficult to use for high gutters. Other former devices will clean in only one direction. Still other devices will not effectively pick up sand or roof granules.

BRIEF SUMMARY OF THE INVENTION

It is an object of the present invention to overcome the aforementioned disadvantages of the prior art.

More specifically, it is an object of the present invention to provide a gutter cleaning device which will fit into the very bottom portion of virtually all modern gutter cross sections.

It is another object of the present invention to provide a gutter cleaning device the working portion of which is sufficiently compact so that it will work around gutter supporting spikes, fit in between closely spaced spikes, and effectively clean the corners of gutters.

It is still another object of the present invention to provide an adjustable gutter cleaning device wherein the angle between the long handle and the active portion of the device which fits into the gutter may be adjusted to any desired and most functional angle.

It is another object of the present invention to provide a gutter cleaning device which will operate in either direction, that is either from right-to-left, or from left-to-right in cleaning a length of gutter.

It is still a further object of the present invention to provide a gutter cleaning device which removes sand, roof granules, and other relatively heavy debris which may accumulate in the bottom of gutters.

It is still further object of the present invention to provide a gutter cleaning device which may be adjusted to hold the end or nozzle of a hose for completely washing out minor residual debris after major debris has been cleaned from gutters.

It is still a further object of the present invention to provide a gutter cleaning device which includes a detachable roof rake for removing accumulated debris such as leaves, pine needles and the like which may have settled on portions of the roof just above or adjacent the gutters on a dwelling or building structure.

The present invention comprises a gutter cleaning device having an operative head portion comprising a pair of gutter cleaning plates 14 each of which has a width which is substantially more narrow than the bottom portion of a typical modern gutter, and is shaped with an angled lip extending away from the central plane of the device. A long handle is attached to the cleaning plates through an elbow-shaped connecting member. Roof rake and hose clamp members are interchangeably useful in place of the cleaning plates.

BRIEF DESCRIPTION OF THE DRAWINGS

Other advantages and further feature of specific preferred embodiments of the present invention will be understood from the following detailed description of those preferred embodiments, in conjunction with the accompanying drawings thereof, wherein:

FIG. 3A is a side view of the advantageous hose or nozzle holder mode of the present invention;

FIG. 3B is an end view of the advantageous hose or nozzle holder mode of the present invention;

FIG. 3C schematically illustrates the advantageous hose or nozzle mode of the present invention in used position for washing residual debris such as roof granules and the like along the length of a section of gutter;

FIG. 4A is a side view of the advantageous gutter cleaning device of the present invention shown in use position in conjunction with a gutter, here illustrated in cross-section;

FIG. 4B is a schematic, perspective view showing the advantageous gutter cleaning device of the present invention in use removing debris from a gutter under a gutter holding spike;

FIG. 5 is a schematic view again illustrating the head portion of the advantageous gutter cleaning device of the present invention in two different use positions illustrated in a gutter, the exterior portion of which is cut away, the left hand portion of the figure illustrating operating the device from left-to-right thereby removing debris from under a gutter holding spike, and the right portion illustrating use of the device from right-to-left again removing debris from under a gutter holding spike.

DETAILED DESCRIPTION

Figure 1A:
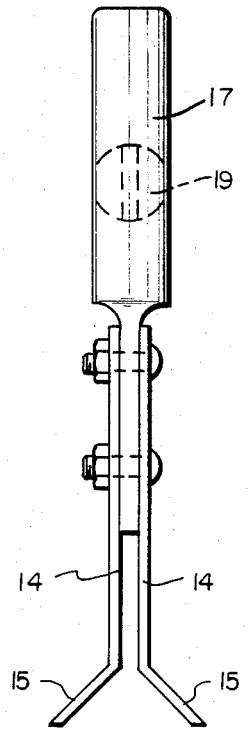
FIG. 1A is an end view of the operative head portion of the gutter cleaning device of the present invention.
Figure 1B:
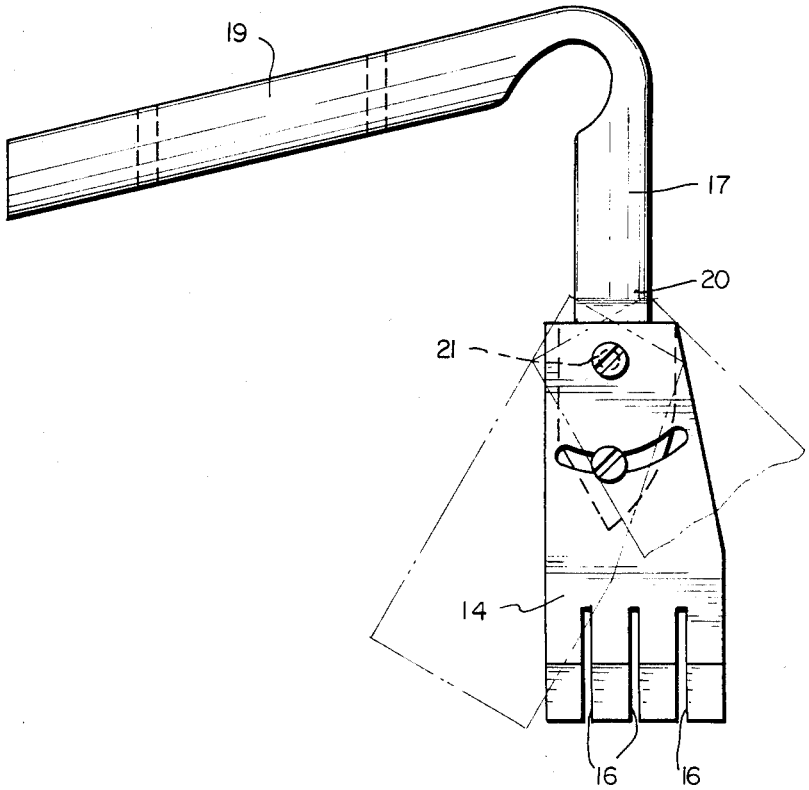
FIG. 1B is a side view of the operative head portion of the gutter cleaning device of the present invention.
Figure 1C:
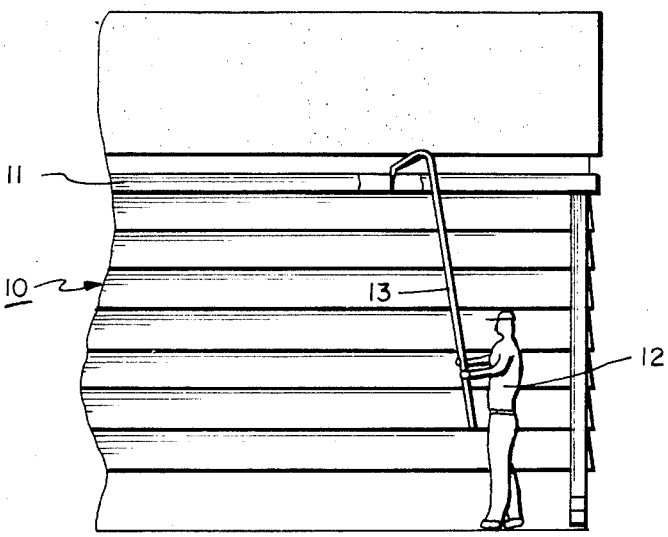
FIG. 1C is a schematic view indicating how the gutter cleaning device of the present invention is used to reach and clean gutter which are substantially above the natural reach of a person standing on the ground below such gutters.

The advantageous gutter cleaning device of the present invention is intended for use in cleaning the gutters attached to the elevated roof of a dwelling 10 as shown generally in FIG. 1C. Also illustrated therein are gutters 11 being cleaned by a person 12 holding the handle 13 of a gutter cleaning tool.

The structure of the operative head portion of the advantageous gutter cleaning device of the present invention is illustrated in FIGS. 1A and 1B. As shown in those figures the operative head portion of the device comprises a pair of gutter cleaning plates 14 each of which is substantially rigid, and has a width which is substantially more narrow than the bottom portion of a typical modern gutter. Each one of the gutter cleaning plates 14 is also shaped with an angled lip 15 extending away from the central plane of the gutter cleaning device of the present invention, and the free ends of those gutter cleaning plates, including the angled lip portions 15, are slotted with slots 16 which permit liquids to pass through the end portions of the gutter cleaning plates when used in cleaning a gutter. The gutter cleaning device of the present invention also comprises a long extended or extension handle section which may be approximately 5 to approximately 20 feet or more in length, depending upon the particular utility. That handle portion should be of substantial strength, and have a diameter or cross sectional dimension of about 1 to 1½ inches, and preferably be made of lightweight material. For example, a telescoping tube of aluminum can make a very satisfactory handle section of adjustable length. Attached to the top end of that handle section is a connecting piece which may be in the shape of an inverted U or inverted V, other curved shape. One end of that connecting piece is connected to the aforementioned handle section, while the other end of the connecting piece is connected to the head portion of the gutter cleaning device. Alternately, the other end of the connecting piece may be attached to hold a cooperating roof rake device, and in another mode that other end of the connecting piece may have attached thereto a hose or hose nozzle clamp head.

Returning now to the gutter cleaning device as illustrated in FIGS. 1A and 1B, the connecting portion 17 is shown in end view in FIG. 1A and side view in FIG. 1B. A portion of the connecting piece which is connected to the handle section is perhaps better shown as portion 19 in FIG. 1B. The other end 20 of the connecting piece 17 has attached thereto the pair of gutter cleaning plates 14. Each of the two ends of the connecting piece 17 have a pair holes, for example quarter-inch holes, therethrough. The handle end 19 of the connecting portion 17 has those holes bored in a direction so that the axes of those holes lie substantially in the central plane of the entire connecting portion, as illustrated in FIG. 1B. However, the holes 21 through which the pair of gutter cleaning plates are attached to the other end of the connecting portion 17 are bored in a direction normal to the central plane of the entire connecting portion so that the generally flat faces of the plates 14 will lie approximately parallel to the central plane of the connecting portion 17, and so that the axis of the handle section will lie substantially in the same plane, or a closely parallel plane, with those gutter cleaning plates. As further illustrated in FIG. 1B, each of the gutter cleaning plates also has at least two holes therein, the hole in the end of the plates opposite the angled lip portion being approximately centrally located in that opposite end, whereas a second hole is an arcuate slot which permits the angular relationship between each of the gutter cleaning plates and the end portion 20 of the connecting section to be adjusted by rotating the plates around a bolt or pin placed through the end-most hole in each of the plates, thus connecting the plates to the connecting portion. This adjustable aspect of the angle of the gutter cleaning plates vis-a-vis the handle section permits each user of the advantageous gutter cleaning device of the present invention to modify that angular relationship to maximize his utility of the advantageous gutter cleaning tool of the present invention.

The advantageous gutter cleaning device of the present invention and the operation thereof are further illustrated in FIGS. 4 and 5. FIG. 4A illustrates the inventive device being used in a gutter, the gutter and dwelling to which it is attached here being illustrated in cross-section, while one of the gutter cleaning plates 14 and connecting portion 17 are shown in side view. As illustrated in FIG. 4A, the connecting portion 17 is shown to be of a generally inverted U-shaped member, the first end of which is connected with the gutter cleaning plates 14, and the other end of which angles away from the U-shaped portion at an angle designed to facilitate use of the device with an extended handle (not illustrated here) which is attached to portion 19 of the connecting piece 17. FIG. 4A also clearly illustrates the width dimension of gutter cleaning plates 14 vis-a-vis the width W of the bottom portion of the cross-section of a modern gutter. As illustrated, the width dimension D of the cleaning plates 14 is no greater than about half of the bottom width dimensions of the gutter. Additionally, FIG. 4A also illustrates the desirability of beveled upper, outer corner portion 22 of cleaning plate 14, which facilitates easy fitting of the gutter cleaning device in a gutter and under the outermost eave portion 23 of the roof or shingle structure.

In use, the advantageous gutter cleaning device of the present invention is moved to and fro in the longitudinal direction of the gutters, while the gutter cleaning plates 14 extend down into the gutter and in contact with the bottom of the gutter as illustrated in FIG. 4A. While the device is moved longitudinally in the gutter it pushes undesirable debris ahead of it, and by rotating the handle (not shown) attached to portion 19 as shown in FIG. 4A, the connecting portion 17 is rotated as indicated by arrow 24 which in turn moves the gutter cleaning plates 14 forward and upward thus flipping or flicking undesirable debris out of the portion of the gutter being cleaned. The aforementioned rotation of the handle can also be used to orient the gutter cleaning plates 14 for cleaning under gutter cleaning spikes 25 as illustrated, for example, in FIG. 4B.

This concept is again illustrated in FIG. 5 where the front portion of the gutter has been cut away at 26 illustrating in the lefthand portion of the figure the operative head portion of the device moving debris 27 from adjacent or under a gutter cleaning spike 28, while the righthand portion of the figure illustrates the other side of the same device removing debris 27' from adjacent or under another spike 28'. This figure also illustrates the relatively small amount of space in which the gutter cleaning device of the present invention may operate. The need for a device which will fit into the corners of gutters, or between closely placed gutter supporting spikes is a significant consideration which various prior art devices were incapable of successfully handling.

It should thus be clear that by varying either the angle A in the connecting portion 17 of the device, as illustrated in FIG. 4, or by varying the angle at which the gutter cleaning plates 14 are connected to end portion 20 of the connecting section, as illustrated in FIG. 1B, the angle between the elongate handle 13 and the gutter cleaning plates 14 may be adjusted so that operation and use of the device is most efficiently manageable by any particular individual using same for cleaning gutters on dwellings or other buildings. This also permits use of the device by a person standing somewhat away from the building thus avoiding debris falling from the gutters being cleaned, and permits one to avoid standing on flower beds, shrubbery, trees or other obstacles located near the building whose gutters are being cleaned.

Figure 2A:
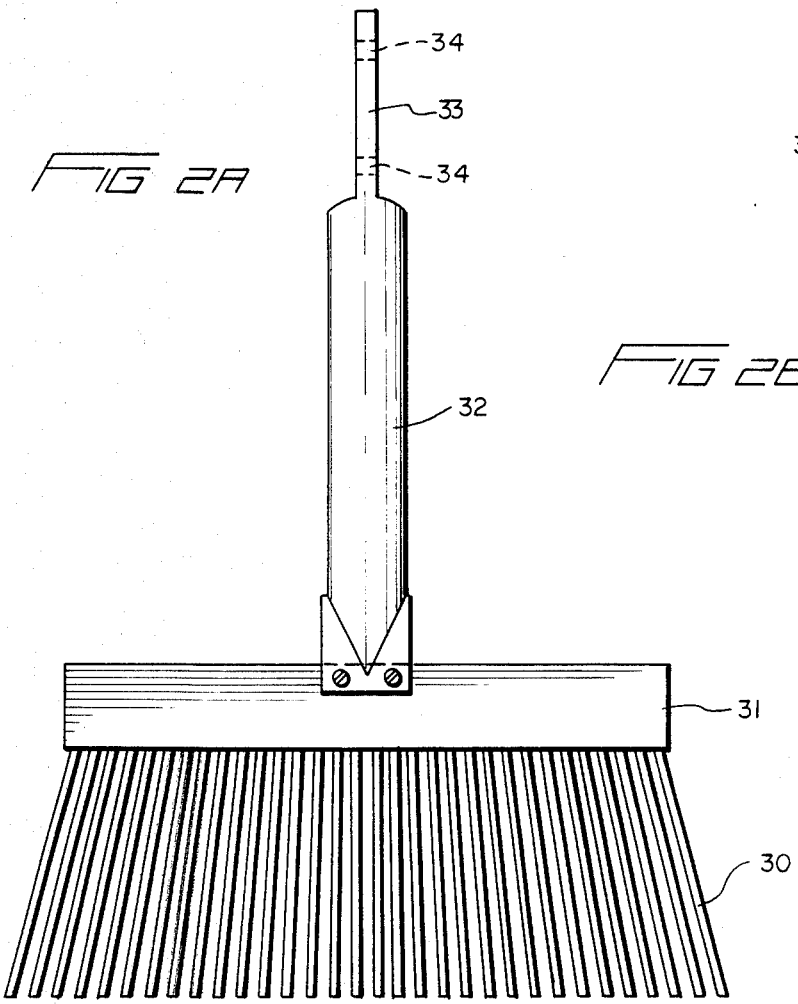
FIG. 2A is a back view of the advantageous roof rake attachment which may be used on the same handle as the gutter cleaning device of the present invention.

FIG. 2A illustrates the advantageous roof rake attachment of the present invention. The roof rake comprises tine 30 shown attached to a header bar 31 which is in turn attached to a throat member 32 the other end of which 33 includes holes 34 through which bolts or other attachment members may be inserted to connect the roof rake attachment either to the elongate handle 13, or to the back side of connecting portion 17 of the gutter cleaning device of the present invention.

Figure 2B:
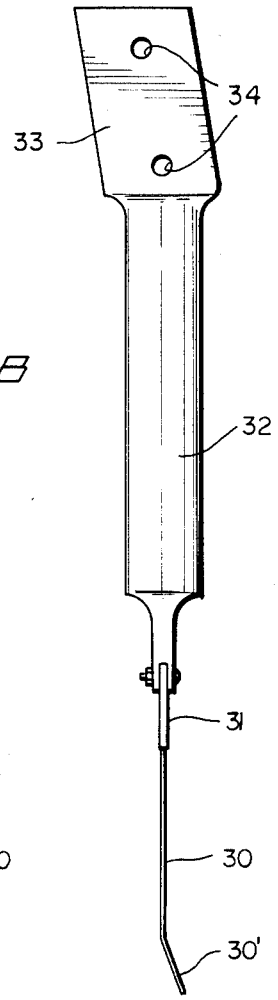
FIG. 2B shows a back view of the connecting end portion of the handle of the advantageous device of the present invention.
Figure 2C:
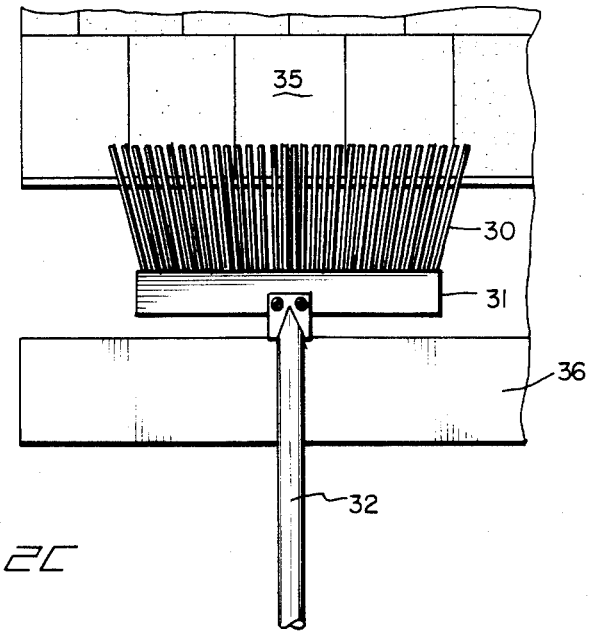
FIG. 2C shows the roof rake device of the present invention in use on roof shingles above and adjacent a gutter on a dwelling or other structure.

In use, the roof rake, when attached to an elongate handle 13, is used with the ends of the tines in contact with the roof, just above and adjacent gutters on a dwelling or other building, as illustrated for example, in FIG. 2C where tines 30 are illustrated over shingles 35 which are above and adjacent gutter 36. The tips of tines 30 may be slightly bent as shown at 30' in FIG. 2B. The downwardly bent tips 30' are usually extending toward the shingle 35 when the roof rake is in use as illustrated in FIG. 2C.

A still further feature of the present invention is the hose or nozzle holding device illustrated in FIG. 3. As shown in FIG. 3A, the end of connecting portion 17 having holes 21 therein may have two plates 40 attached thereto, which plates hold the end of a hose, or a nozzle 41 as illustrated in any of FIGS. 3A, B, C, or D. It should also be clear that the hose or nozzle holding plates 40 may in fact be the same gutter cleaning plates 14 as previously illustrated, for example, in FIG. 1B. The use of such gutter cleaning plates 14 is illustrated in FIG. 3D. In the particular use of the hose or nozzle holding device as illustrated in FIG. 3D, the gutter cleaning plates 14 are shown oriented at a very substantial angle to the axis of connecting portion 17, here to facilitate aiming the nozzle 41 directly down a downspout portion 42 of gutter 43. The other typical mode of use of the hose or nozzle holding device is shown in FIG. 3C wherein the nozzle or end of the hose 41 is held in the orientation illustrated in FIGS. 3A and 3B and can be pointed down the length of gutter 43, a top view of which is shown in FIG. 3C. In this way, water emerging from nozzle 41 sprays down the length of the gutter 43 washing residual debris down the gutter to a point of accumulation, or even down a downspout.

It should thus be clear from the foregoing disclosure that the advantageous gutter cleaning system of the present invention comprises not only the gutter cleaning plate devices 14 illustrated in FIGS. 1, 4 and 5, but also the roof rake attachment illustrated in FIG. 2 and the hose or nozzle holding system illustrated in FIG. 3. Together this system of interchangeable parts fulfills virtually all of the needs of a complete gutter cleaning system, and is simple to manufacture and use, and when used will efficiently and thoroughly remove all undesirable debris from gutters on a dwelling or other building.

While various proportions and alternate elements or embodiments of the present invention may occur to those skilled in the art, such alternate dimensions, elements, or embodiments, when within the spirit of the present disclosure and the scope of the following claims, are considered to be part of the advantageous gutter cleaning system of the present invention.

What is claimed is:

1. A gutter cleaning device for removing debris from gutters on a building for controlling liquid run-off from the roof of the building, comprising:

a generally elbow-shaped connecting member one end of which is adapted to carry gutter cleaning means, and the other end of which is adapted to be connected to an elongate handle member; and a pair of removably mounted gutter cleaning plates of substantially planar material, a first end portion of each plate is connected to the connecting member such that said pair of plates are connected back-to-back on each side of the connecting member, and a second end portion of each plate is substantially rectangular in shape, the width of the rectangular portion being not greater than about one half of the width of the bottom of a gutter, said second end portions having bent ends thereof, the ends being bent out of the plane of the rectangular portion, whereby when said pair of plates are removably mounted in a first position, said bent ends are divergent to permit removal of debris from gutters on a building and when said pair of plates are removably mounted in a second position, said bent ends are convergent to permit holding of a hose member therebetween.

2. The device of claim 1, wherein the gutter cleaning plates are adjustably connected to the connecting member so that the angle which they make vis-a-vis the connecting member may be substantially varied.

3. The device of claim 1 having a handle member connected to the other end of the connecting member.

4. The device of claim 3, wherein said handle member is a telescoping extension handle.

5. The device of claim 3, additionally comprising a rake member detachably connectable to the connecting member, for removing leaves and other debris from portions of a building roof adjacent gutters on the building.

6. The device of claim 1, wherein each of the gutter cleaning plates has a plurality of slots extending from the second end portion thereof a short distance toward, the first end portion thereof.

7. The device of claim 1, wherein the connecting member is an elongate member extending in a U-shaped path, with the axis of the member lying substantially in one plane, and the gutter cleaning plates are in planes parallel to the axial plane of the connecting member.

8. The device of claim 7, having an elongate handle member connected to the other end of the connecting member, and the axis of the handle member also lies substantially in the axial plane of the connecting member.

9. The device of claim 1, wherein a corner of the gutter cleaning plates at their first end and furthest from said other end of the connecting member are beveled toward the second end portion of the plates, for facilitating use of the device in gutters having partially overhanging roof material.

10. The device of claim 1, wherein the gutter cleaning plates are not greater than about $1\frac{1}{2}$ inches in width at the second end portion thereof.

* * * * *